US005772046A

United States Patent [19]

Tercher et al.

[11] Patent Number: 5,772,046

[45] Date of Patent: Jun. 30, 1998

[54] FOOD STORAGE BAG HOLDER

[76] Inventors: Richard A. Tercher; June G. Tercher, both of 3960 S. Kirkwood Ave., St. Francis, Wis. 53235

[21] Appl. No.: 519,078

[22] Filed: Aug. 24, 1995

[51] Int. Cl.[6] ..... A47F 5/00

[52] U.S. Cl. ..... 211/12; 211/43; 211/184; 248/95

[58] Field of Search ..... 211/43, 184, 11, 211/12, 175; 248/99, 97, 907

[56] References Cited

U.S. PATENT DOCUMENTS

| | | | |
|---|---|---|---|
| 1,006,328 | 10/1911 | Widenhofer | 211/43 |
| 2,545,844 | 12/1951 | Cougias | 211/43 |
| 3,063,567 | 11/1962 | Campbell | 211/43 |
| 3,598,350 | 8/1971 | Kaufman | 248/97 |
| 3,614,042 | 10/1971 | Jensen | 248/97 |
| 3,679,064 | 7/1972 | Howkinson | 211/43 |
| 4,469,300 | 9/1984 | Valesko | 248/97 |

FOREIGN PATENT DOCUMENTS

| | | | |
|---|---|---|---|
| 22741 | 6/1883 | Germany | 211/43 |
| 45111 | 11/1980 | Germany | 211/43 |
| 261537 | 11/1926 | United Kingdom | 211/43 |

*Primary Examiner*—Alvin C. Chin-Shue
*Assistant Examiner*—Gwendolyn W. Baxter
*Attorney, Agent, or Firm*—William R. Walbrun

[57] ABSTRACT

A food storage bag holder device is provided for holding a bag in an open position to facilitate filling. The device includes a main base. A first pair of parallel sides are respectively mounted to the main base. The first pair of parallel sides has first upper edges sized for receiving and supporting a first bag in an open position. The main base and first pair of parallel sides substantially define a main interior space therewithin. A second base is provided. A second pair of parallel sides are respectively mounted to the second base. The second pair of parallel sides has second upper edges sized for receiving and supporting a second bag in an open position. The second base being positionable in a storage position within the main interior space in parallel adjacency with the main base for compact storage of the device.

21 Claims, 9 Drawing Sheets

FOOD STORAGE BAG HOLDER

BACKGROUND OF THE INVENTION

1. Field of the Invention

The present invention relates generally to a bag holder. More particularly, the invention pertains to a food storage bag holder for supporting a flexible plastic bag in an open position to facilitate filling of the bag.

2. Description of the Prior Art

Plastic bags are increasingly being used as food storage containers. Reclosable plastic bags, such as ZIPLOC bags, are commonly used plastic bags which offer an effective and low cost manner of sealing food items within the bag for storage in a cupboard, refrigerator, or freezer. Reclosable plastic bags are conveniently available in a multitude of sizes, such as sandwich, quart, gallon, and two gallon sizes, and provide for a disposable manner of storage without having to resort to plastic or glass containers which require cleaning.

While plastic bags offer an effective alternative for food storage, the filling of plastic bags can be problematic due to the flexible and collapsible nature of the plastic bag. This problem is further enhanced when filling a plastic bag with food powders, sauces, or fluids.

Various prior art devices are known in the art for providing a support structure for holding a plastic bag in an open position to facilitate filling. These devices suffer from being expensive and cumbersome and are more adapted for receiving a plastic bag to be used for trash or garbage. Furthermore, these devices are directed to supporting a single size plastic bag and do not allow for holding plastic bags of differing size. Therefore, such devices are ineffective for use in food storage preparation, when food storage bags are conveniently supplied in a range of sizes, all of which are significantly smaller than typical garbage or trash bags.

As will be described in greater detail hereinafter, the bag holder device of the to present invention differs from those previously proposed and employs a number of novel features that render it highly advantageous over the prior art.

SUMMARY OF THE INVENTION

Accordingly, it is an object of this invention to provide a bag holder device for receiving and supporting a food storage bag in an open position to facilitate easy filling of the bag.

Another object of this invention is to provide a bag holder device capable of holding more than one size of bag.

Still another object of this invention is to provide a bag holder device that is compact in size when the device is not in use and placed in a storage position.

Yet another object of this invention is to provide a bag holder that is easy to use and inexpensive to manufacture.

To achieve the foregoing and other objectives, and in accordance with the purposes of the present invention a storage bag holder device is provided. The device includes a main base. A first pair of parallel sides are respectively mounted to the main base in a spaced apart relationship with the first pair of parallel sides upwardly extending from the main base defining a first slot with open first slots ends. The first pair of parallel sides has first upper edges sized for receiving and supporting a first bag in an open position with the first bag having a mouth for folded overlapping engagement with the first upper edges. The main base and first pair of parallel sides substantially define a main interior space therewithin. A second base is provided. A second pair of parallel sides are respectively mounted to the second base in a spaced apart relationship along with the second pair of parallel sides upwardly extending from the second base defining a second slot with open second slots ends. The second pair of parallel sides has second upper edges sized for receiving and supporting a second bag in an open position with the second bag having a mouth for folded overlapping engagement with the second upper edges. The second base being positionable in a storage position within the main interior space in parallel adjacency with the main base.

In accordance with an aspect of the invention, the main base has a channel. The first pair of parallel sides each has a pair of inner side edges and a top inner side edge defining an inner side space extending upwardly from the channel. The second base slidably engaging the channel. The second pair of parallel sides being disposed within respective inner side spaces and substantially coplanar with the first pair of parallel sides when in a storage position.

In accordance with another aspect of the invention, the channel has a pair of channel sides. Each channel side has a groove. The second base has a pair of guide members with each guide member slidably engaging a respective groove.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
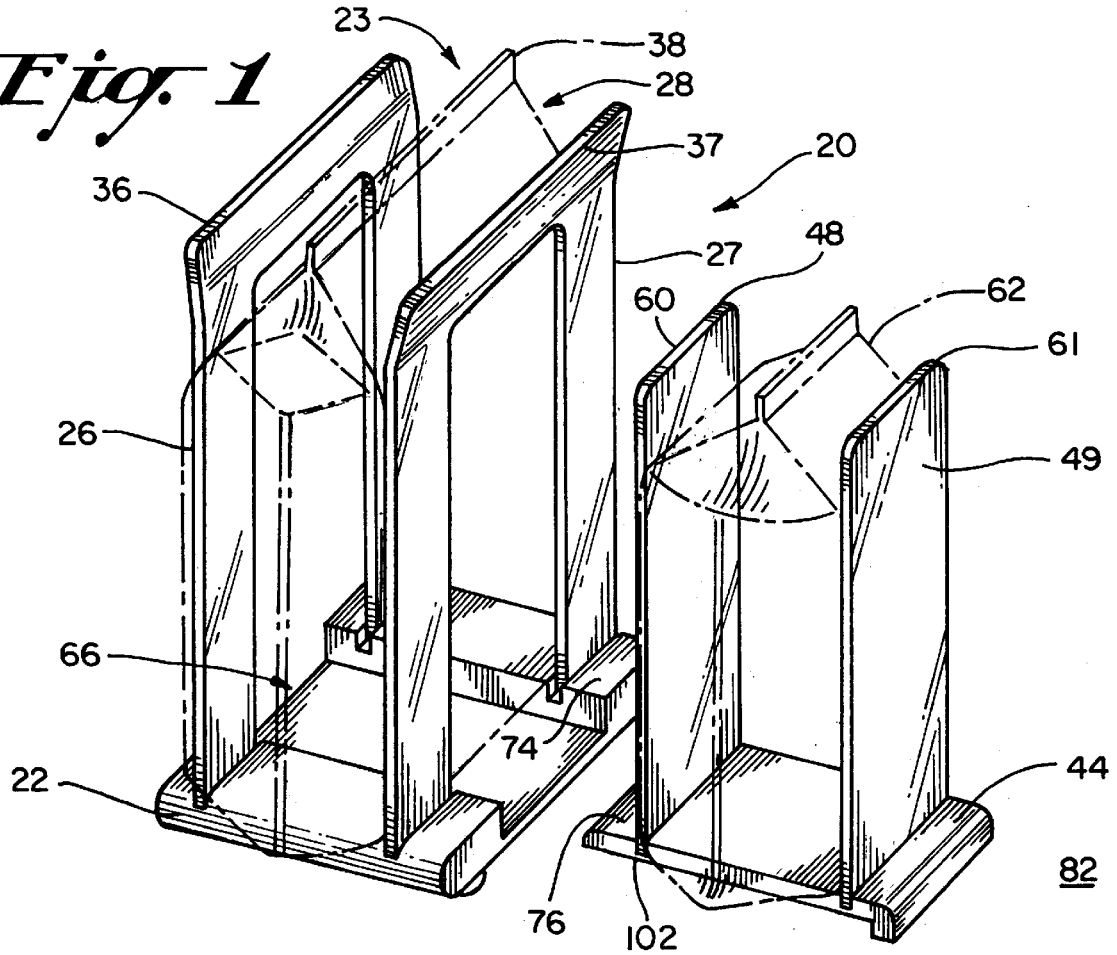
FIG. 1 is a perspective view of a first embodiment of the present invention in an operational position.
Figure 2:
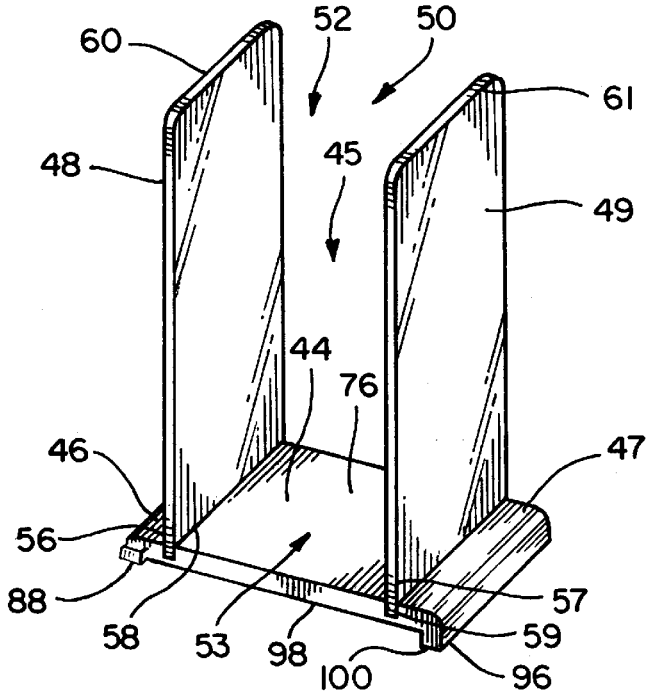
FIG. 2 is a perspective view of the center bag holder of the first embodiment.
Figure 3:
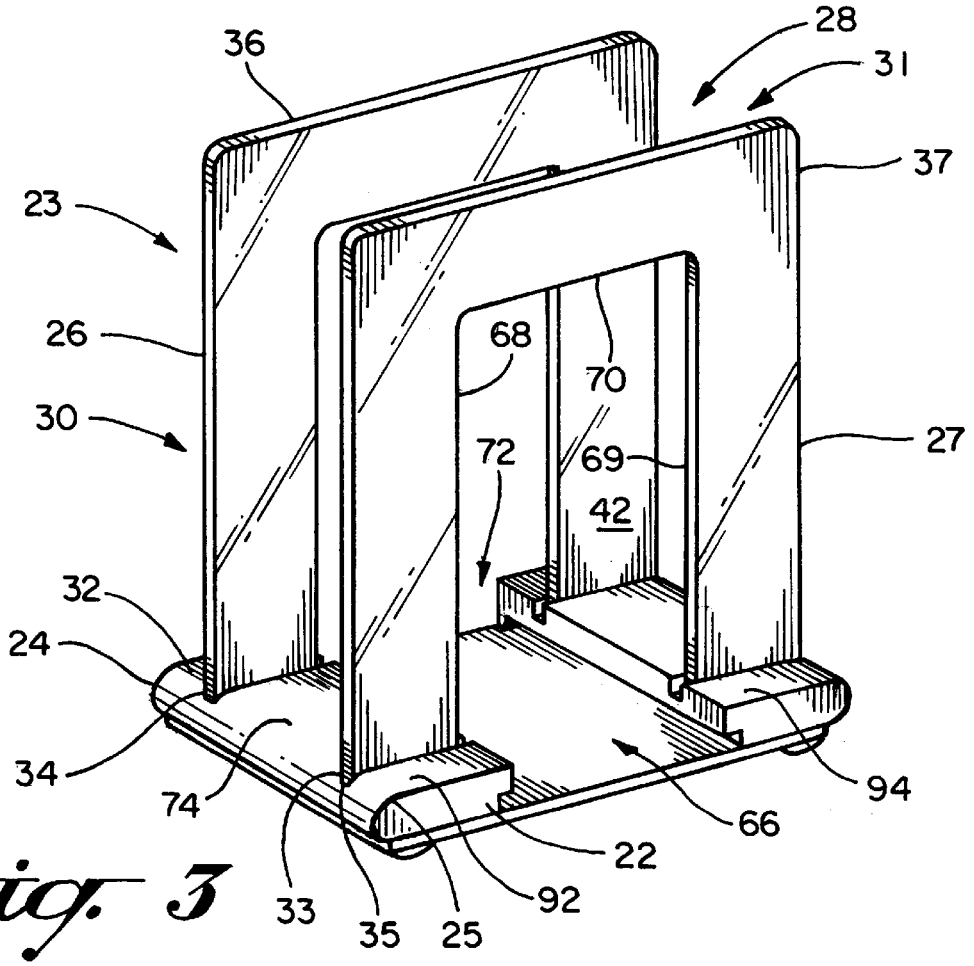
FIG. 3 is a perspective view of the main bag holder of the first embodiment.
Figure 4:
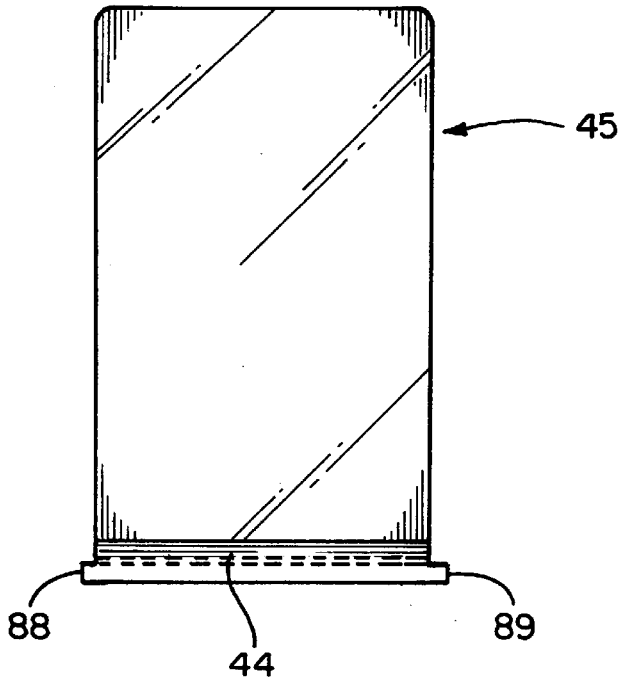
FIG. 4 is a side view of the center bag holder of FIG. 2.

Referring now to the drawings, a storage bag holder device 20 is illustrated in FIG. 1. A generally rectangular main base 22 has a pair of first side edges 24, 25. A first pair of parallel sides 26, 27 are respectively mounted to the main base 22 in a spaced apart relationship along respective first side edges 24, 25 with the first pair of parallel sides 26, 27 upwardly extending from the main base 22 to provide a main bag holder 23. The sides 26, 27 and main base 22 of the main bag holder 23 define a first slot 28 with open first slots ends 30, 31 on opposite ends of the first slot 28. As shown in the drawings, the first slot 28 extends horizontally between the open first slots ends 30, 31.

The parallel sides 26, 27 are mounted to the base 22 by having lower side edges 32, 33 respectively engaging elongated slots 34, 35 on the first side edges 24, 25. Adhesive of conventional type may be used to further secure the edges 32, 33 in the slots 34, 35. Alternatively, the parallel sides 26, 27 may be formed integral with the main base 22.

Figure 9:
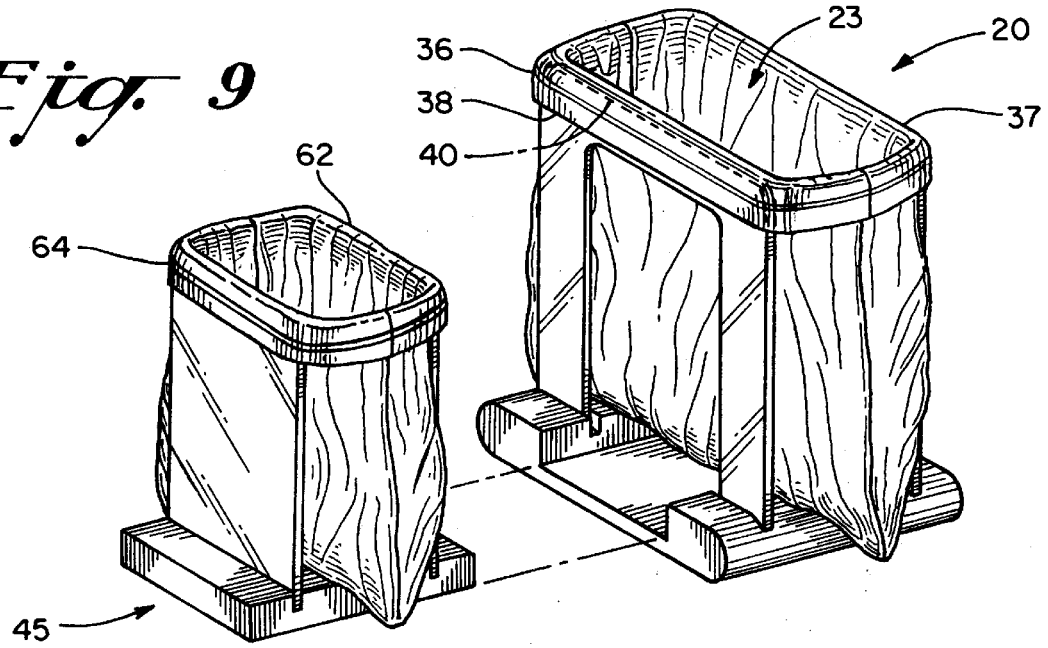
FIG. 9 is a perspective view of the second embodiment of the present invention in an operational position with first and second plastic bags in an open position.
Figure 13:
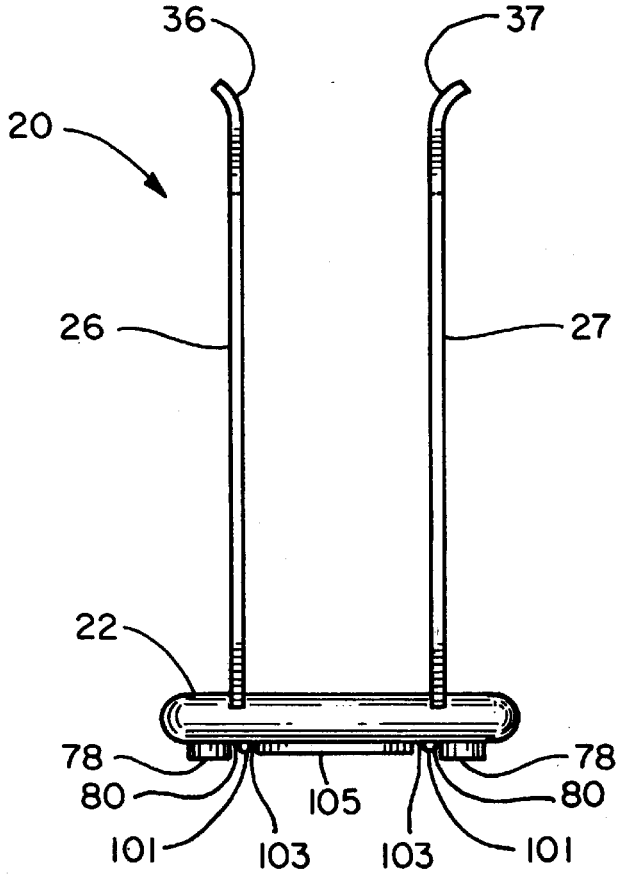
FIG. 13 is a side view of the second embodiment taken along line 13—13 of FIG. 11.

The first pair of parallel sides 26, 27 have first upper edges 36, 37 sized for receiving and supporting a flexible plastic bag or first bag 38 in an open position with the first bag 38 having a mouth 40 for folded overlapping engagement with the first upper edges 36, 37, as illustrated in FIG. 9. The open slot ends 30, 31 allow the sides of the bag to extend through. Preferably, the main bag holder 23 is sized for holding a gallon size plastic food storage bag. The main base 22 and first pair of parallel sides 26, 27 substantially define a main interior space 42 therewithin. Preferably, the first upper edges 36, 37 are bent or curved in opposing direction from one another, as best shown in FIG. 13, for improved engagement with the mouth 40 of the bag 38.

A center or second base 44 has a pair of second side edges 46, 47. A second pair of parallel sides 48, 49 are respectively mounted to the second base 44 in a spaced apart relationship along respective second side edges 46, 47 with the second pair of parallel sides 46, 47 upwardly extending from the second base 44 to provide a center bag holder 45. The sides 48, 49 and base 44 of the holder 45 define a second slot 50 with open second slots ends 52, 53 on opposite ends of the second slot 50. As shown in the drawings, the second slot 50 extends horizontally between the open second slots ends 52, 53.

The sides 48, 49 are mounted to the second base 44 in similar fashion to the first pair of sides 26, 27 by having lower side edges 56, 57 of the sides 48, 49 engaging corresponding elongated slots 58, 59 of the second side edges 46, 47. Adhesive may be used to secure the edges 56, 57 to the second base 44. The sides 48, 49 may also be formed integral with the second base 44.

Figure 11:
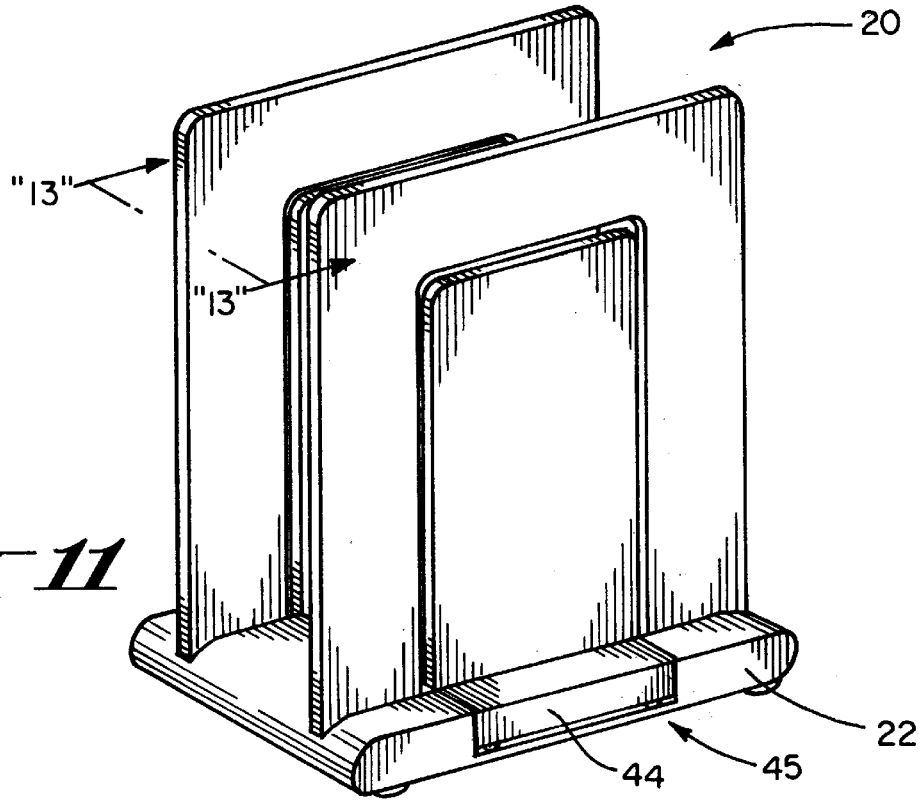
FIG. 11 is a perspective view of the second embodiment of the present invention in a storage position.
Figure 12:
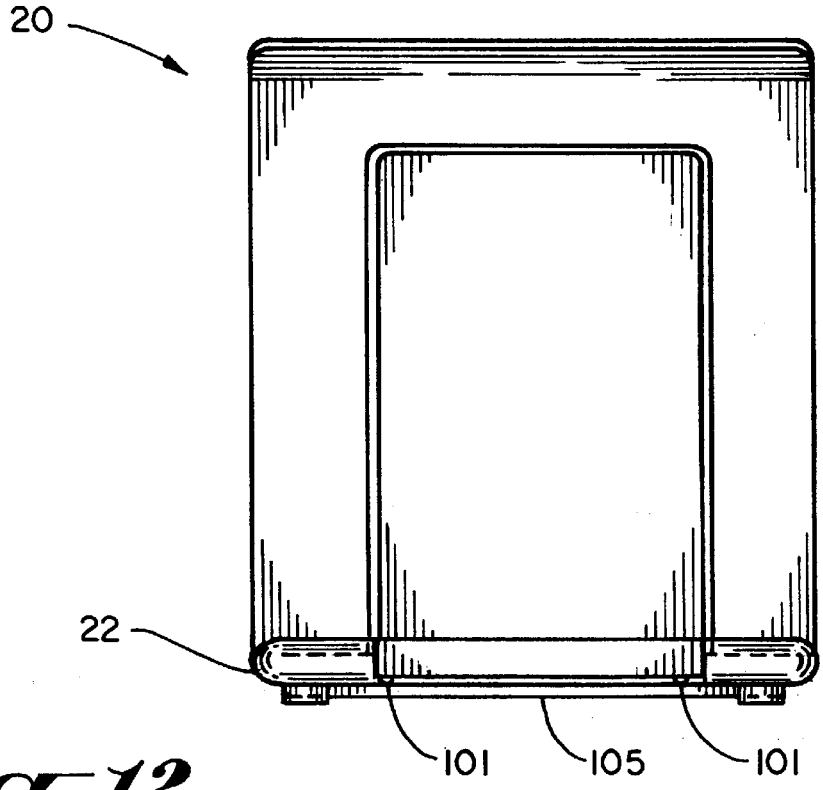
FIG. 12 is a side view of the second embodiment of the present invention.
Figure 14:
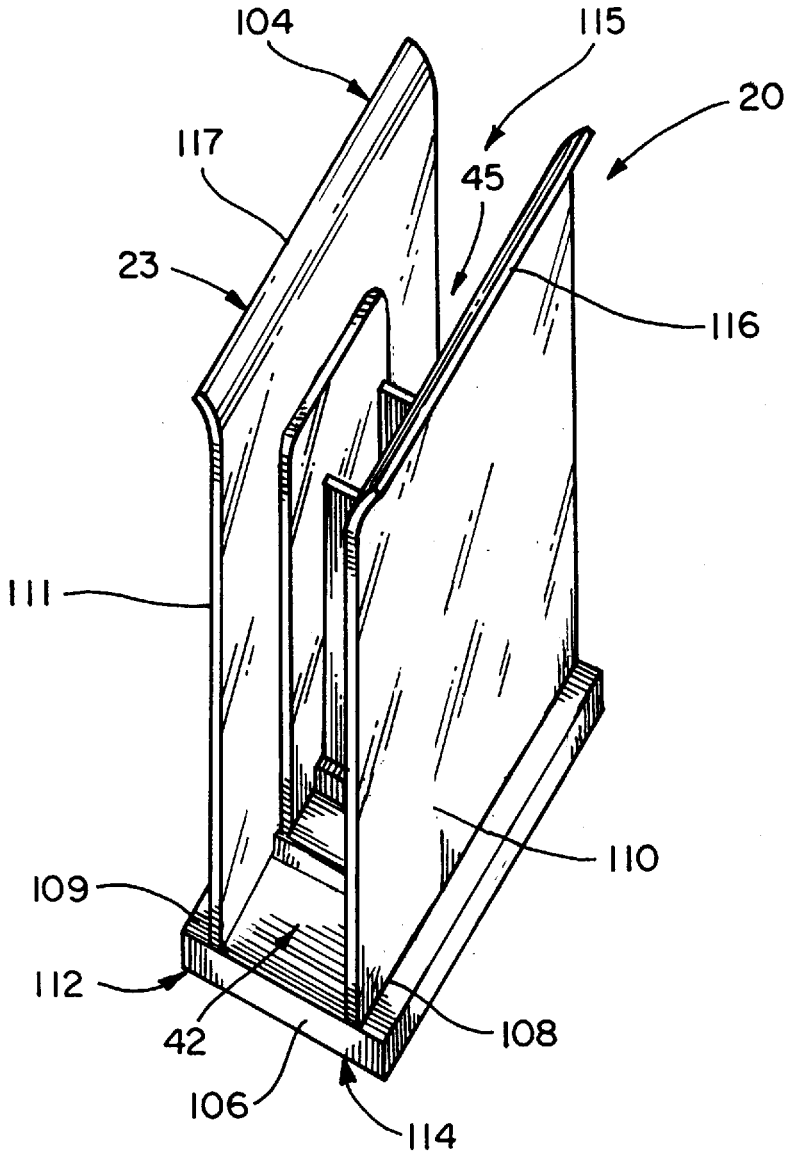
FIG. 14 is a perspective view of a third embodiment of the present invention.
Figure 15:
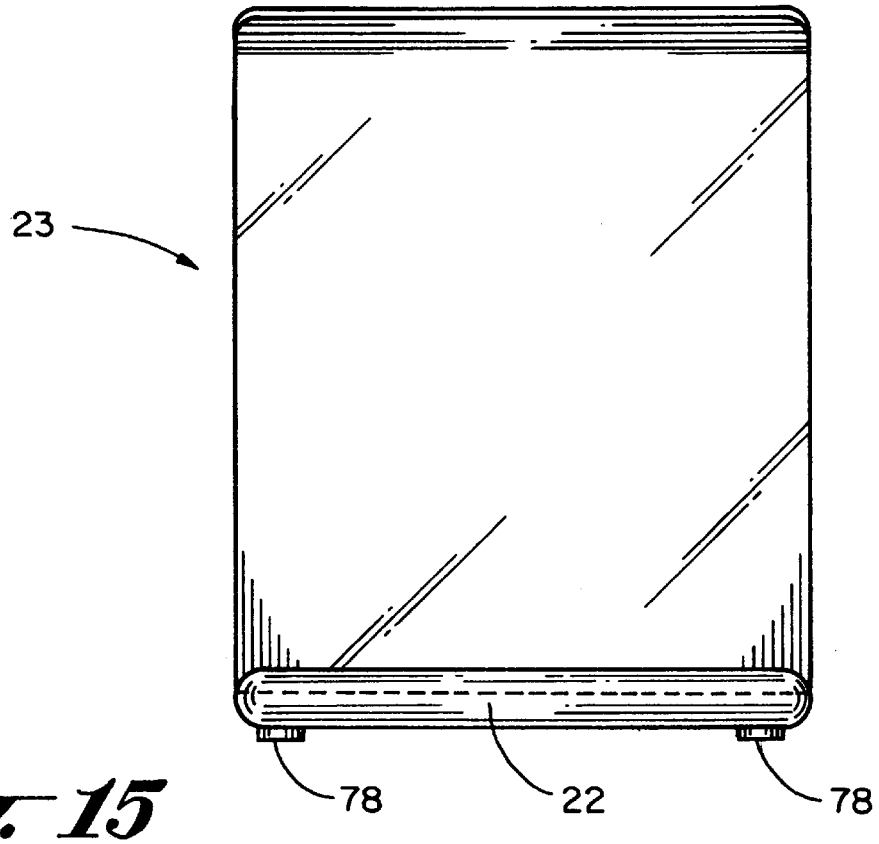
FIG. 15 is a side view of the main bag holder of FIG. 14.
Figure 16:
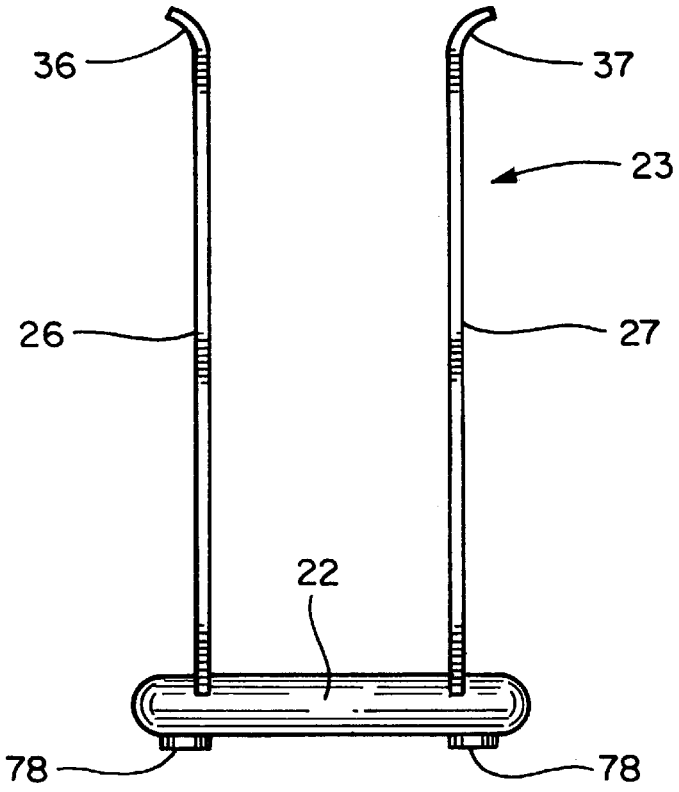
FIG. 16 is an end view of the main bag holder of FIG. 15.
Figure 17:
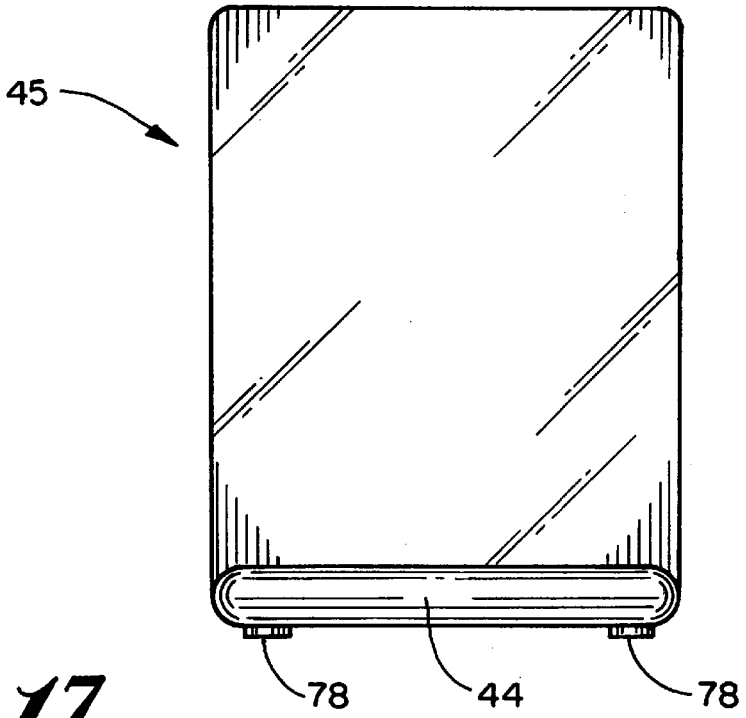
FIG. 17 is a side view of the center bag holder of FIG. 14.
Figure 18:
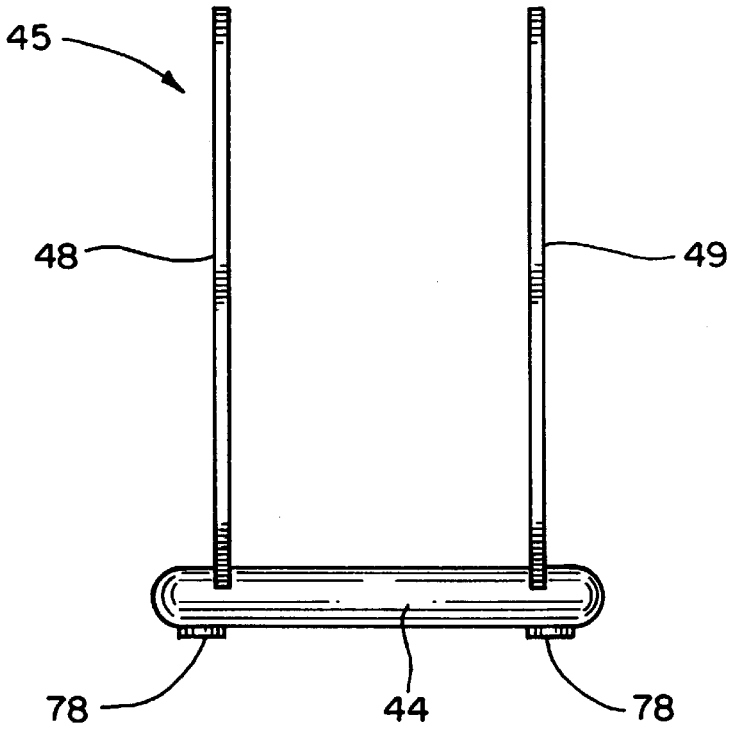
FIG. 18 is an end view of the center bag holder of FIG. 17.

The second pair of parallel sides 48, 49 have second upper edges 60, 61 sized for receiving and supporting a plastic bag or second bag 62 in an open position with the second bag 62 having a mouth 64 for folded overlapping engagement with the second upper edges 60, 61, as illustrated in FIG. 9. The open slot ends 52, 53 allow the sides of the bag to extend through. Preferably, the center bag holder 23 is sized for holding a quart size plastic food storage bag. As shown in FIG. 11 and 14, the second base 44 is positionable in a storage position within the main interior space 42 in parallel adjacency with the main base 22 so that the device 20 is compact in size for easy storage.

Referring to FIGS. 1–7, a first embodiment of the device 20 is illustrated. A second embodiment is illustrated in FIGS. 8–13. In both the first and second embodiments, the main base 22 has a channel 66 extending transversely across the main base 22. The first pair of parallel sides 26, 27 each have a pair of inner side edges 68, 69 vertically extending and connecting with a horizontal top inner side edge 70 to define an inner side space or slot 72 of a generally rectangular shape which extends upwardly from the channel 66. The second base 44 slidably engages the channel 66 for movement therewithin. The second pair of parallel sides 48, 49 are sized and configured to be disposed within respective inner side spaces or slots 72 and substantially coplanar with the first pair of parallel sides 26, 27 when in a storage position, as illustrated in FIG. 11.

Figure 10:
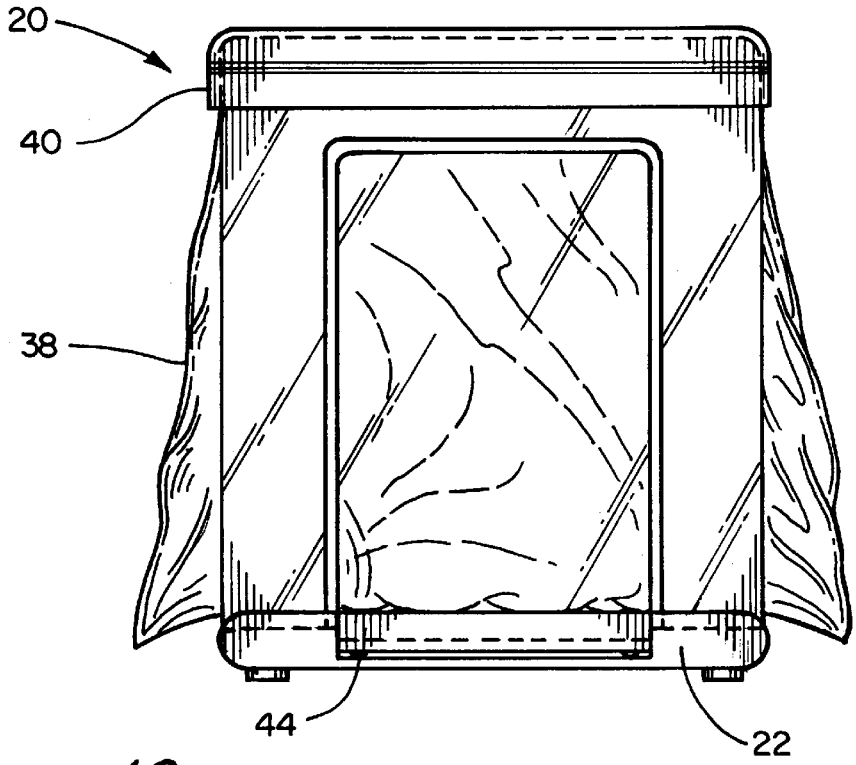
FIG. 10 is a perspective view of the second embodiment of the present invention in a storage position with a first plastic bag in an open position engaging the main bag holder.

An upper surface 74 of the main base 22 is coplanar with an upper surface 76 of the second base 44. Therefore, when the center bag holder 45 is the storage position with the main bag holder 23, the first slot 28 is unencumbered so that the first bag 38 may be supported with the main bag holder 23 without having to remove or reposition the center bag holder 45, as illustrated in FIG. 10.

Rubber or plastic feet 78 may be attached to a bottom surface 80 of the main base 22 with adhesive or any other suitable means for providing non-slip engagement of the device 20 on a support surface 82.

Figure 5:
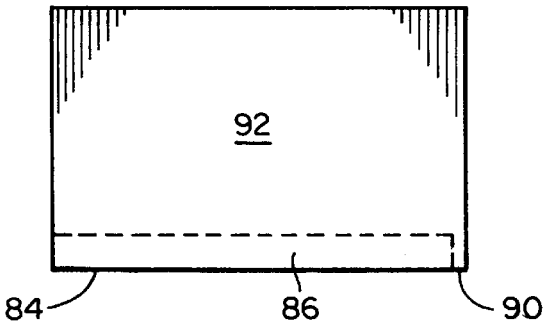
FIG. 5 is a partial top view of a right side portion of the base of the first embodiment.
Figure 6:
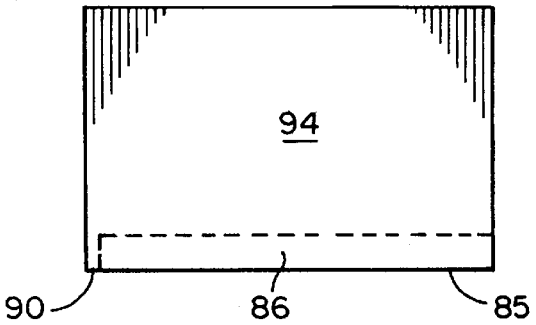
FIG. 6 is a partial top view of left side portion of the base of the first embodiment.
Figure 7:
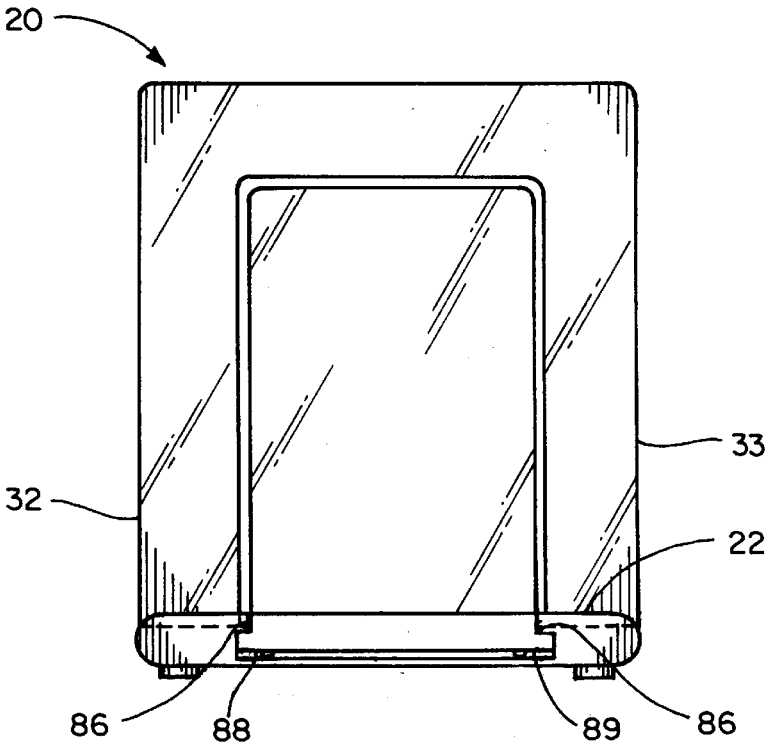
FIG. 7 is a side view of the main bag holder of FIG. 3.
Figure 8:
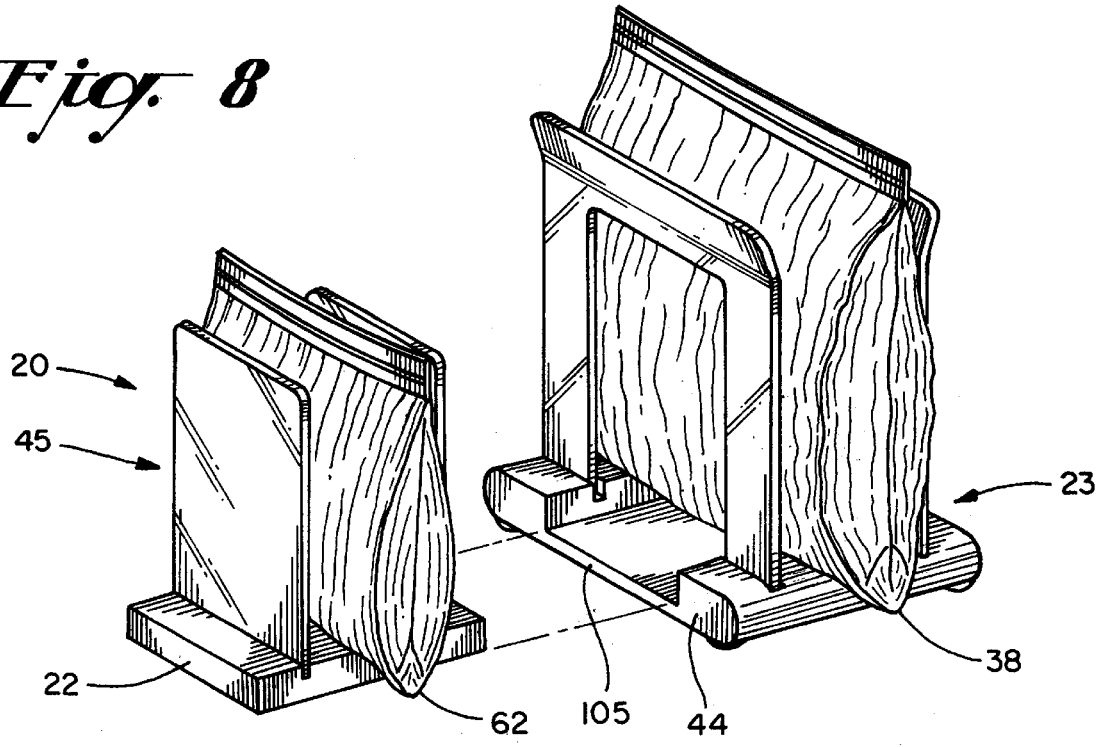
FIG. 8 is a perspective view of a second embodiment of the present invention in an operational position.

Referring now to the first embodiment shown in FIGS. 1–7, the channel 66 has a pair of channel sides 84, 85. Each channel side 84, 85 has a slot or groove 86. The second base 44 has a pair of extending guide members 88, 89 with each guide member 88, 89 slidably engaging a respective groove 86 of the channel sides 84, 85. A first end of each groove 86 contains a stop 90 formed integral with a respective right side portion 92 or left side portion 94 of the main base 22, as shown in FIGS. 5 and 6, to prevent the second base 44 from being pulled completely out of the channel 66 when moving the second base 44 from an operational or filling position to a storage position.

The second base 44 has an extending lower member 96 downwardly extending from a bottom surface 98 of the base 44 at a side edge. The lower member 96 has a lower outer surface 100. The lower member 96 is in pressing engagement with a support surface 82 when the second base is in a filling position to maintain the second base 44 in a parallel relationship with the support surface 82, as shown in FIG. 1. The outer surface 100 of the lower member 96 is in confronting engagement with an outer side surface 102 of the main base 22 when the second base 44 is in the storage position. To remove the second base 44 from engagement with the grooves, the end of the base containing the lower member 96 can be raised at a level above the channel 66 allowing the base 44 to be slid across the channel 66 and then separated from the main base 22, providing an easy way to disassemble the device for cleaning.

Referring to the second embodiment of the device 20 shown in FIGS. 8–13, it can be seen that second base 44 does not contain guide members and can be separated into an operational or filling position remote from the position of the main base 22. To secure the second base 44 within the channel 66 so the base 44 does not unintentionally disengage, a plurality of plastic tabs 101 are mounted on a bottom side of the second base 44 or formed integral with the base 44. The tabs are disposed adjacent to outer edges 103 of a lower portion 105 of the second base when in the storage position to produce frictional type engagement allowing the tabs to hold the base 44 secure until a sufficient force allows the base 44 to slide across the channel 66.

Referring to FIGS. 14–18, a third embodiment of the device 20 is shown. The center bag holder 45 is disposed in nested engagement within the main interior space 42 of the main bag holder 23 when in the storage position shown in FIG. 14. The holder 45 is then removable from the space 42 for placement on a support surface 82 in the filling position as similarly shown for the second embodiment in FIG. 9.

A third bag holder 104 is provided. The holder 104 is formed in a manner similar to the main bag holder 23 previously described. The holder 104 has a rectangular third base 106 having a pair of third side edges 108, 109 and is preferably sized for holding a two-gallon size plastic bag. A third pair of parallel sides 110, 111 are respectively mounted to the third base 106 in a spaced apart relationship along respective third side edges 108, 109 with the third pair of parallel sides 110, 111 upwardly extending from the third base 106 to define a third slot 112 with open third slots ends 114, 115. The third pair of parallel sides 110, 111 having third upper edges 116, 117 sized for receiving and supporting a third bag in a manner similar to the first bag. The main base 22 and first pair of parallel sides 26, 27 being positionable in nested engagement within the third slot 112 in a storage position.

Although the invention has been described by reference to some embodiments it is not intended that the novel device be limited thereby, but that modifications thereof are intended to be included as falling within the broad scope and spirit of the foregoing disclosure, the following claims and the appended drawings.

We claim:

1. A storage bag holder, comprising in combination:

(a) a main base having a pair of first side edges;

(b) a first pair of parallel sides respectively mounted to the main base in a fixed spaced apart relationship along respective the first side edges with the first pair of parallel sides upwardly extending from the main base defining a first slot extending horizontally and vertically upwardly between open first slots ends of the first slot, the first pair of parallel sides having first upper edges sized for receiving and supporting a first bag in an open position with the first bag having a mouth for folded overlapping engagement with the first upper edges, the main base and the first pair of parallel sides substantially defining a main interior space therewithin;

(c) a second base having a pair of second side edges; and (d) a second pair of parallel sides respectively mounted to the second base in a fixed spaced apart relationship along the respective second side edges with the second pair of parallel sides upwardly extending from the second base defining a second slot extending horizontally and vertically upwardly between open second slots ends of the second slot, the second pair of parallel sides having second upper edges sized for receiving and supporting a second bag in an open position with the second bag having a mouth for folded overlapping engagement with the second upper edges, the second base being positionable in a storage position within the main interior space in parallel adjacency with the main base.

2. The storage bag holder of claim 1, wherein the main base has a channel, the first pair of parallel sides each having a pair of inner side edges and a top inner side edge defining an inner side space extending upwardly from the channel, the second base slidably engaging the channel, the second pair of parallel sides disposed within respective inner side spaces and substantially coplanar with the first pair of parallel sides in a storage position.

3. The storage bag holder of claim 2, further comprising means attached to the second base for securing the second base within the channel when in a storage position.

4. The storage bag holder of claim 2, wherein the channel has a pair of channel sides, each channel side having a groove, the second base having a pair of guide members with each guide member slidably engaging the respective groove.

5. The storage bag holder of claim 1, further comprising a third base having a pair of third side edges and a third pair of parallel sides respectively mounted to the third base in a spaced apart relationship along the respective third side edges with the third pair of parallel sides upwardly extending from the third base defining a third slot with open third slots ends, the main base and the first pair of parallel sides being positionable in nested engagement within the third slot in a storage position.

6. The storage bag holder of claim 1, wherein the first upper edges are bent in opposing direction from one another.

7. A food storage bag holder device, comprising:

(a) a main base having a pair of first side edges, the main base having a channel;

(b) a first pair of parallel sides respectively mounted to the main base in a spaced apart relationship along respective the first side edges with the first pair of parallel sides upwardly extending from the main base, the first pair of parallel sides each having a pair of inner side edges and a top inner side edge defining an inner side slot extending upwardly from the channel and through each respective side, the first pair of parallel sides having first upper edges sized for receiving and supporting a first bag in an open position with the first bag having a mouth for folded overlapping engagement with the first upper edges;

(c) a second base having a pair of second side edges, the second base slidably engaging the channel; and (d) a second pair of parallel sides respectively mounted to the second base in a spaced apart relationship along the respective second side edges with the second pair of parallel sides upwardly extending from the second base, the second pair of parallel sides having second upper edges sized for receiving and supporting a second bag in an open position with the second bag having a mouth for folded overlapping engagement with the second upper edges, the second pair of parallel sides disposed within respective inner side slots and substantially coplanar with the first pair of parallel sides in a storage position.

8. The device of claim 7, further comprising means attached to the second base for securing the second base within the channel when in a storage position.

9. The device of claim 8, wherein the means attached to the second base for securing the second base within the channel includes a plurality of tabs mounted on a bottom side of the second base adjacent to outer edges of a lower portion of the second base when in a storage position.

10. The device of claim 7, wherein the channel has a pair of channel sides, each channel side having a groove, the second base having a pair of guide members with each guide member slidably engaging the respective groove.

11. The device of claim 7, wherein an upper surface of the main base is coplanar with an upper surface of the second base.

12. The device of claim 7, wherein the first upper edges are bent in opposing direction from one another.

13. The device of claim 7, further comprising means attached to a bottom surface of the main base for providing non-slip engagement of the device on a support surface.

14. A device for holding a plastic bag in an open position, the device comprising:

(a) a main base having a pair of first side edges, the main base having a channel;

(b) a first pair of parallel sides respectively mounted to the main base in a fixed spaced apart relationship along the respective first side edges with the first pair of parallel sides upwardly extending from the main base defining a first slot perpendicular to the channel with open first slots ends, the first pair of parallel sides each having a pair of inner side edges and a top inner side edge defining an inner side slot extending upwardly from the channel and through each respective side, the first pair of parallel sides having first upper edges sized for receiving and supporting a first plastic bag in an open position with the first plastic bag having a mouth for folded overlapping engagement with the first upper edges;

(c) a second base having a pair of second side edges, the second base slidably engaging the channel, an upper surface of the second base being coplanar with an upper surface of the main base; and (d) a second pair of parallel sides respectively mounted to the second base in a fixed spaced apart relationship along the respective second side edges with the second pair of parallel sides upwardly extending from the second base defining a second slot with open second slots ends, the second pair of parallel sides having second upper edges sized for receiving and supporting a second plastic bag in an open position with the second plastic bag having a mouth for folded overlapping engagement with the second upper edges, the second pair of parallel sides disposed within respective inner side slots and substantially coplanar with the first pair of parallel sides in a storage position.

15. The device of claim 14, further comprising means attached to the second base for securing the second base within the channel when in a storage position.

16. The device of claim 15, wherein the means attached to the second base for securing the second base within the channel includes a plurality of tabs mounted on a bottom side of the second base adjacent to outer edges of a lower portion of the second base when in a storage position.

17. The device of claim 14, wherein the channel has a pair of channel sides, each channel side having a groove, the second base having a pair of guide members with each guide member slidably engaging the respective groove.

18. The device of claim 17, wherein the second base has an extending lower member, the extending lower member having a lower outer surface, the lower member being in pressing engagement with a support surface when the second base is in a filling position to maintain the second base in a parallel relationship with the support surface.

19. The device of claim 18, wherein the first upper edges are bent in opposing direction from one another.

20. The device of claim 19, further comprising means attached to a bottom surface of the main base for providing non-slip engagement of the device on the support surface.

21. A storage bag holder, comprising in combination:

(a) a main base having a pair of first side edges;

(b) a first pair of parallel sides respectively mounted to the main base in a spaced apart relationship along respective the first side edges with the first pair of parallel sides upwardly extending from the main base defining a first slot with open first slots ends, the first pair of parallel sides having first upper edges sized for receiving and supporting a first bag in an open position with the first bag having a mouth for folded overlapping engagement with the first upper edges, the main base and the first pair of parallel sides substantially defining a main interior space therewithin, the first upper edges being bent in opposing direction from one another for engagement with the mouth the first bag;

(c) a second base having a pair of second side edges; and (d) a second pair of parallel sides respectively mounted to the second base in a spaced apart relationship along the respective second side edges with the second pair of parallel sides upwardly extending from the second base defining a second slot with open second slots ends, the second pair of parallel sides having second upper edges sized for receiving and supporting a second bag in an open position with the second bag having a mouth for folded overlapping engagement with the second upper edges, the second base being positionable in a storage position within the main interior space in parallel adjacency with the main base.

* * * * *